US012551073B2

(12) United States Patent
Dai et al.

(10) Patent No.: US 12,551,073 B2
(45) Date of Patent: Feb. 17, 2026

(54) GROUND CLEANING DEVICE

(71) Applicant: Anker Innovations Technology Co., Ltd., Changsha (CN)

(72) Inventors: Rongkun Dai, Shenzhen (CN); Chuoying Lu, Shenzhen (CN); Chunhong Li, Shenzhen (CN); Guisheng Nong, Shenzhen (CN); Qinghe Fan, Shenzhen (CN)

(73) Assignee: Anker Innovations Technology Co., Ltd., Changsha (CN)

( * ) Notice: Subject to any disclaimer, the term of this patent is extended or adjusted under 35 U.S.C. 154(b) by 368 days.

(21) Appl. No.: 18/214,189

(22) Filed: Jun. 26, 2023

(65) Prior Publication Data

US 2024/0000277 A1 Jan. 4, 2024

(30) Foreign Application Priority Data

Jun. 30, 2022 (CN) ..... 202210763710.4
Jun. 30, 2022 (CN) ..... 202221665009.0

(51) Int. Cl.
*A47L 9/28* (2006.01)
*A47L 5/30* (2006.01)

(52) U.S. Cl.
CPC ..... *A47L 9/2852* (2013.01); *A47L 5/30* (2013.01); *A47L 9/2857* (2013.01)

(58) Field of Classification Search
CPC ..... A47L 9/2852; A47L 5/30; A47L 9/2857; A47L 5/14; A47L 5/225
See application file for complete search history.

(56) References Cited

U.S. PATENT DOCUMENTS

2015/0000069 A1 1/2015 Conrad et al.
2016/0015227 A1* 1/2016 Conrad ..... A47L 9/1608 15/344

(Continued)

FOREIGN PATENT DOCUMENTS

CN 204128145 U 1/2015
CN 106963287 A 7/2017

(Continued)

OTHER PUBLICATIONS

Apr. 12, 2023—(EP) Extended European Search Report—App. No. 23181856.8.

(Continued)

*Primary Examiner* — Andrew A Horton
(74) *Attorney, Agent, or Firm* — Banner & Witcoff, Ltd.

(57) ABSTRACT

The present disclosure describes a ground cleaning device that comprises a ground brush, a main body, and a fan. The fan may be located inside the main body and may comprise an air inlet and an air outlet. The main body may comprise a main air outlet channel, a front air outlet channel, and a rear air outlet channel. One end of the main air outlet channel may be connected to a switching device, which has a first state and a second state. Based on the switching device being in the first state, the switching device may close the rear air outlet channel to disconnect the main air outlet channel from the rear air outlet channel. Based on the switching device being in the second state, the switching device may open the rear air outlet channel to connect the main air outlet channel to the rear air outlet channel.

20 Claims, 7 Drawing Sheets

(56) References Cited

U.S. PATENT DOCUMENTS

| | | | | |
|---|---|---|---|---|
| 2017/0296006 | A1* | 10/2017 | Wang | A47L 9/0063 |
| 2018/0000303 | A1* | 1/2018 | Conrad | A47L 9/127 |

FOREIGN PATENT DOCUMENTS

| | | | |
|---|---|---|---|
| CN | 114098553 | A | 3/2022 |
| CN | 114431763 | A | 5/2022 |
| EP | 2789282 | A1 | 10/2014 |
| EP | 3424391 | A1 | 1/2019 |

OTHER PUBLICATIONS

Jun. 25, 2025—(CN) Chinese Office Action—App. No. 202210763710.4.

* cited by examiner

GROUND CLEANING DEVICE

CROSS-REFERENCE TO RELATED APPLICATIONS

The present application claims priority to CN Application No. 202210763710.4, filed on Jun. 30, 2022, and CN Application No. 202221665009.0, filed on Jun. 30, 2022. Each of the above applications is incorporated by reference in its entirety.

FIELD

The present application relates to the technical field of ground cleaning, in particular to a ground cleaning device.

BACKGROUND

After mopping the floor, there is usually residual water on the ground, which can cause the floor to be slippery and lead to accidents. Additionally, the trampling before the ground is dry is easy to leave water stains with footprints. Traditional cleaning devices use a scraper, a sponge, or a cloth that can absorb water to wipe the floor, but the floor may remain slippery for a long time.

SUMMARY

It may be beneficial to provide a ground cleaning device that can quickly dry the wet and slippery floor (e.g., after traditional cleaning devices are used).

A ground cleaning device may comprise a ground brush assembly, a main body, a fan assembly, and a switching mechanism. The ground brush assembly may be connected to the main body and may comprise a suction port. The fan assembly may be located on the main body and may comprise an air inlet and an air outlet. The main body may comprise a main air outlet channel, a front air outlet channel, and a rear air outlet channel. The suction port may be connected to the air inlet. One end of the main air outlet channel may be connected to the air outlet, and the other end of the main air outlet channel may be equipped with the switching mechanism. The switching mechanism may comprise a first state and a second state. When the switching mechanism is in the first state, the switching mechanism may close the rear air outlet channel to isolate the main air outlet channel from the rear air outlet channel. When the switching mechanism is in the second state, the switching mechanism may open the rear air outlet channel to connect the main air outlet channel with the rear air outlet channel. The rear air outlet channel may be used to direct the airflow to the cleaning surface, and the front air outlet channel may be used to direct the airflow to the front of the ground cleaning device.

The ground cleaning device may further comprise a recovery box located on the main body. The recovery box may comprise a recovery channel, and the suction port may be connected to the air inlet through the recovery channel. The main air outlet channel and the front air outlet channel may be separated by the recovery box and the main body.

The main air outlet channel may extend from top to bottom along the height direction of the main body. The outlet of the main air outlet channel may be vertically opposite to the inlet of the rear air outlet channel, and the front air outlet channel may extend in the direction of the ground cleaning device.

The main air outlet channel may comprise at least two outlets, and the front air outlet channel and the rear air outlet channel may each have at least two outlets.

The ground cleaning device may further comprise a bent pipe. One end of the bent pipe may be connected to the main body, and the other end of the bent pipe may be connected to the floor brush component. The bent pipe may be used to connect the suction port and the recovery channel. The recovery box may be detachably connected to the main body.

The fan assembly may be detachably connected to the main body, and the air inlet and the air outlet may be both located on the side of the fan assembly close to the ground brush assembly.

The fan assembly may comprise a fan body and an air outlet shell. The fan body may be located inside the air outlet shell, and the air inlet and the air outlet may be both located at the bottom of the air outlet shell. The air inlet and the air outlet may be arranged along the direction of the ground cleaning device, and the air inlet may be located in front of the air outlet.

The switching mechanism may comprise a switching cover that is movably connected to the main body and can move relative to the main body between the first state and the second state. The switching mechanism may further comprise a pivot and a lever. The switching cover may be rotatably connected to the main body through the pivot, and one end of the lever may be fixed to the pivot, and the other end of the lever may extend out of the main body. The switching mechanism may further comprise a driving member, which is connected to the switching cover for driving the switching cover to move relative to the main body.

The main body may be provided with (e.g., comprise, connected to) a first sensing switch, and when the switching mechanism is in the first state, the switching cover can contact the first sensing switch. The main body may be provided with a second sensing switch, and when the switching mechanism is in the second state, the switching cover can contact the second sensing switch.

The ground cleaning device may further comprise a controller, which is connected to the driving member. The controller may be configured to control the driving member to drive the switching cover to move according to the received instructions of front or rear air outlet (e.g., based on a user instruction). When the controller receives a sensing signal sent by the first sensing switch or the second sensing switch, the controller controls the driving member to stop running.

When an operating current of the driving member is greater than or equal to the preset current and the controller receives a sensing signal sent by the first sensing switch or the second sensing switch, the driving member may continue running for T1 seconds before stopping. When the operating current of the driving member is greater than or equal to the preset current and the controller receives a sensing signal from the first or second induction switch, the controller may control the driving member to stop running. When the operating current of the driving member is greater than or equal to the preset current and the controller does not receive an induction signal sent by the first sensing switch or the second sensing switch, the controller may control the driving member to continue running for T2 seconds, and if the controller still does not receive a sensing signal sent by the first sensing switch or the second sensing switch (e.g., after T2 seconds), the controller may control the driving member to stop running. The controller may control the driving member to drive the switching cover to move for T3 seconds according to the received instructions of front or rear air outlet. When the operating current of the driving member is greater than or equal to the preset current, the controller may control the driving member to stop running. When the operating current of the driving member is less than the preset current, the controller may control the driving member to continue running for T4 seconds, and if the operating current of the driving member is still less than the preset current, the controller may control the driving member to stop running.

The ground cleaning device may such in air through the suction port, and the air may flow into the fan assembly through the inlet port, then blow out through the outlet port of the fan assembly, and then enter the main outlet channel. When the floor is wet and slippery, the switching mechanism may switch to the second state (e.g., based on a user instruction), and the main outlet channel may be connected to the rear outlet channel, so that the fan assembly blows air towards the rear lower side of the main body, which can quickly dry the wet and slippery cleaning surface. At other times, the switching mechanism can be switched to the first state to isolate the main outlet channel from the rear outlet channel. The main outlet channel may be connected to the front outlet channel, and the airflow is directed towards the front of the floor cleaning device, so that the fan blows towards the front side of the main body, avoiding the air blowing directly to the user, while reducing the wind noise heard by the user and improving the user's experience.

REFERENCE NUMERALS

Figure 1:
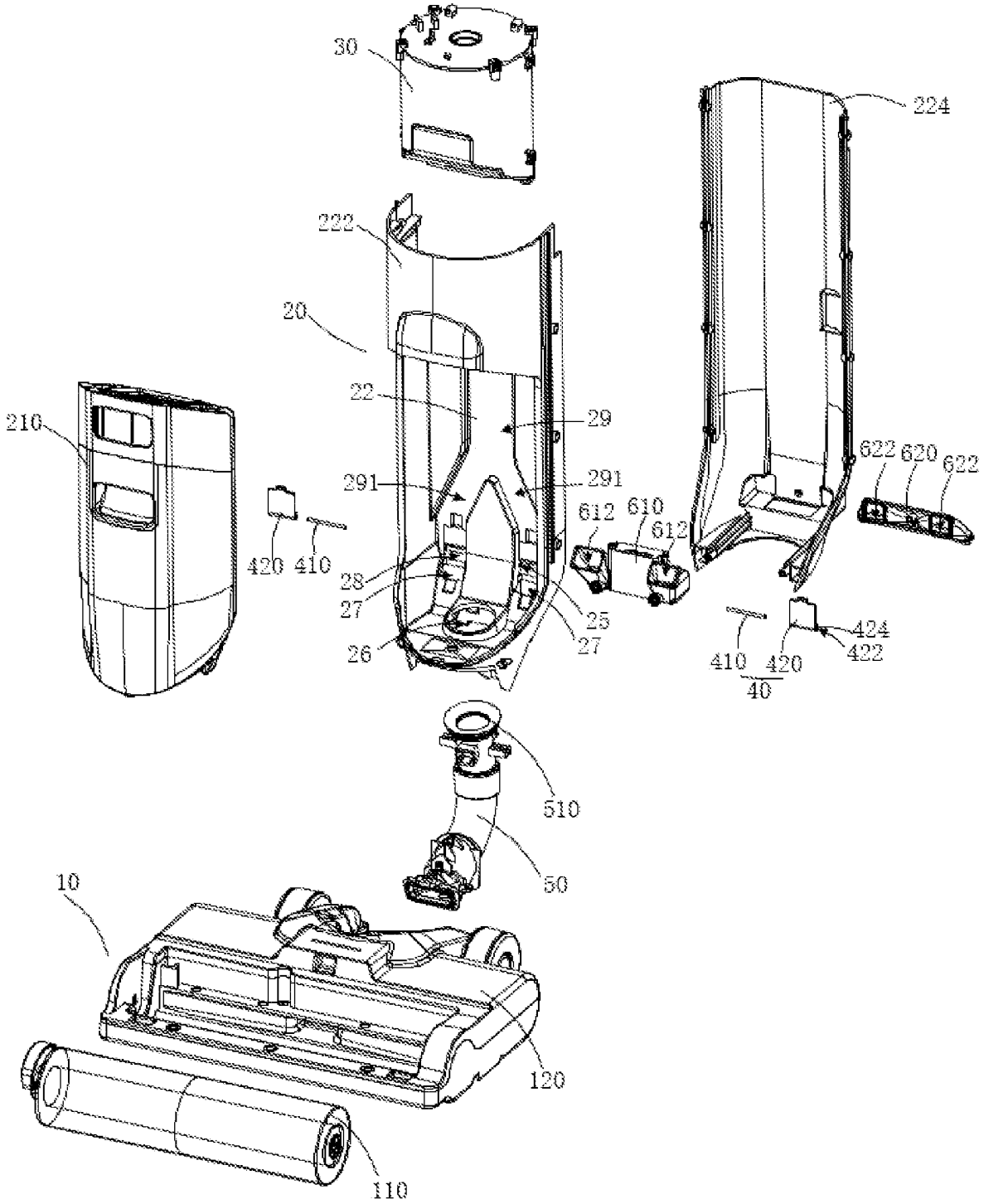
FIG. 1 is an exploded view of a ground cleaning device.
Figure 2:
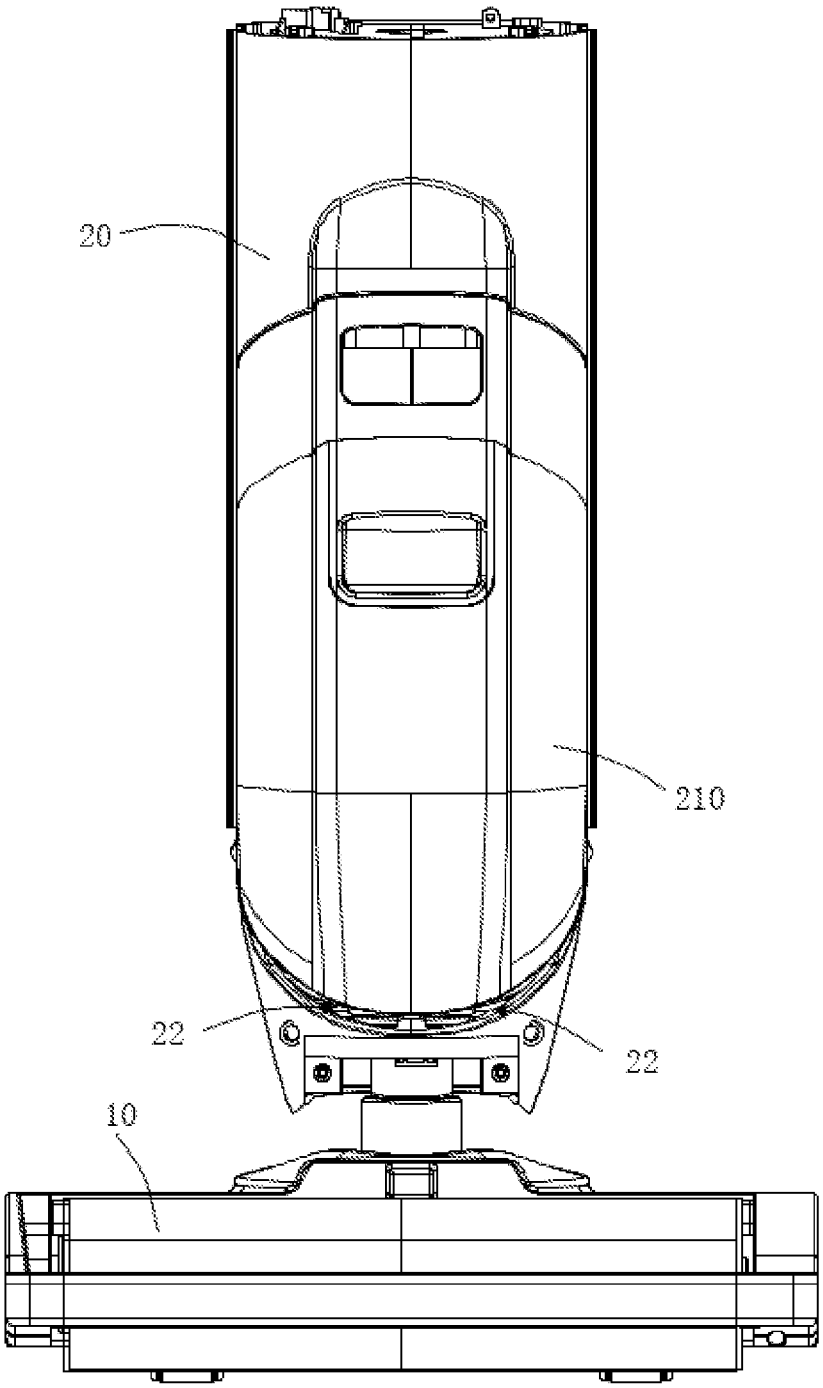
FIG. 2 is a front view of the ground cleaning device.

10, ground brush assembly; 11, suction port; 110, cleaning member; 120, connecting body; 20, main body; 22, main air outlet channel; 23, front air outlet channel; 24, rear air outlet channel; 25, mounting hole; 26, connecting hole; 27, opening; 28, embedding groove; 29, groove; 291, branch; 210, recovery box; 21, recovery channel; 212, second sealing ring; 214, air duct; 216, guide plate; 222, main shell; 224, rear shell; 30, fan assembly; 31, air inlet; 32, air outlet; 310, fan body; 320, air outlet shell; 40, switching mechanism; 410, pivot shaft; 420, switching cover; 422, shaft hole; 424, card platform; 430, lever; 50, bent pipe; 510, first sealing ring; 60, rear air outlet assembly; 610, first pipe shell; 612, first air duct; 620, second pipe shell; 622, second air duct.

DETAILED DESCRIPTION

In order to make the above objects, features, and advantages of the present disclosure more apparent and understandable, specific examples of the present disclosure will be described in detail below in conjunction with the accompanying drawings. Many specific details are described below to fully understand the present disclosure. However, the present disclosure can be implemented in many different ways other than those described herein, and those skilled in the art can make similar improvements without departing from the spirit of the present disclosure, so the present disclosure is not limited to the specific examples disclosed below.

In the description of the present disclosure, it should be understood that the terms "center," "longitudinal." "horizontal." "length." "width," "thickness," "up," "down," "front," "rear," "left," "right," "vertical," "horizontal," "top," "bottom," "inside," "outside," "clockwise," "counterclockwise." "axial," "radial," "circumferential," and the like indicate the orientation or positional relationship based on the orientation or positional relationship shown in the drawings, and are only for the purpose of facilitating the description of the present disclosure and simplifying the description, and do not indicate or imply that the device or element referred to must have a specific orientation, be constructed and operated in a specific orientation, and therefore cannot be understood as limiting the present disclosure.

In addition, the terms "first" and "second" are used only for descriptive purposes and cannot be construed as indicating or implying relative importance or implying the number of technical features indicated. Therefore, features limited by "first" and "second" may include at least one such feature, either explicitly or implicitly. The meaning of "multiple" is at least two, such as two, three, etc., unless otherwise specifically limited.

Unless otherwise specifically provided or limited, terms such as "installation," "connection." "linkage," and "fixation" should be broadly understood, for example, it can be a fixed connection, a detachable connection, or an integral connection; it can be a mechanical connection or an electrical connection; it can be directly connected or indirectly connected through an intermediate medium, and can be a communication between two components or a mutual interaction relationship between two components. For those skilled in the art, the specific meaning of the above terms in the present disclosure can be understood according to specific circumstances.

Unless otherwise specifically provided or limited, the first feature "on" or "under" the second feature can be the first and second features in direct contact or indirectly in contact through an intermediate medium.

Moreover, the first feature "above," "on top of," and "on" the second feature can be the first feature directly above or diagonally above the second feature, or only indicate that the first feature is at a higher horizontal height than the second feature. The first feature "below," "under," and "underneath" the second feature can be the first feature directly below or diagonally below the second feature, or only indicate that the first feature is at a lower horizontal height than the second feature. It should be noted that when an element is referred to as "fixed to" or "set on" another element, it can be directly on the other element or there may be an intermediate element. When an element is considered to be "connected" to another element, it may be directly connected to the other element or there may be an intermediate element. The terms "vertical,", "horizontal," "up," "down,", "left," "right," and similar expressions used in this disclosure are for illustrative purposes only.

Referring to FIGS. 1, 2, 5, 6, and 7, the present application describes a floor cleaning device (e.g., a ground cleaning device). The floor cleaning device may comprise a brush assembly 10, a main body 20, and a fan assembly 30. The fan assembly 30 may be disposed on the main body 20 and comprise an air inlet 31 and an air outlet 32. The brush assembly 10 may be connected to the main body 20 and comprise a suction port 11. Any suitable handle may be used to facilitate the movement of the floor cleaning device. The main body 20 may have a main air outlet channel 22 (e.g., an exhaust duct), a front air outlet channel 23, and a rear air outlet channel 24. The suction port 11 may be connected to the air inlet 31. One end (e.g., a first end) of the main air outlet channel 22 may be connected to the air outlet 32, and the other end (e.g., a second end) of the main air outlet channel 22 may be provided with (e.g., connected to) a switching mechanism 40 (e.g., a switching device). The switching mechanism 40 may be configured to control (e.g., switch) the direction of the airflow in the main air outlet channel 22.

The switching mechanism 40 may have a first state and a second state. In the first state, the switching mechanism 40 may close the rear air outlet channel 24 to isolate the main air outlet channel 22 from the rear air outlet channel 24, and the other end of the main air outlet channel 22 may be connected to the front air outlet channel 23, directing the airflow to the front of the floor cleaning device, so that the fan assembly 30 blows air towards the front of the main body 20. In the second state, the switching mechanism 40 may open the rear air outlet channel 24, and the other end of the main air outlet channel 22 may be connected to the rear air outlet channel 24, directing the airflow to the cleaning surface, so that the fan assembly 30 blows air towards the lower rear of the main body 20.

In the second state, the main air outlet channel 22 and the front air outlet channel 23 may be kept connected or closed. By arranging the directions of the main air outlet channel 22, the front air outlet channel 23, and the rear air outlet channel 24, the airflow of the main air outlet channel 22 may be directed entirely to the rear air outlet channel 24, or partially to the rear air outlet channel 24 and partially to the front air outlet channel 23. In the second state, the main air outlet channel 22, the rear air outlet channel 24, and the front air outlet channel 23 may be all connected, and the airflow of the main air outlet channel 22 may be directed entirely to the rear air outlet channel 24. The direction of the arrow in FIG. 5 indicates that the airflow in the floor cleaning device may have two switchable flow directions, and the directions of the arrows in FIGS. 6 and 7 indicate the directions of the airflows in different actual use scenarios.

After the fan assembly 30 is started, air may be sucked in through the suction port 11, and may continue to flow through the air inlet 31 into the interior of the fan assembly 30. The air may then be blown out through the air outlet 32, and enter the main air outlet channel 22. When the floor is wet and slippery, the switching mechanism 40 may switch to the second state, and the other end of the main air outlet channel 22 may be connected to the rear air outlet channel 24, so that the fan assembly 30 blows air towards the lower rear of the main body 20, which can quickly dry the wet and slippery cleaning surface. In an example, at other times, the switching mechanism 40 can be switched to the first state to isolate the main air outlet channel from the rear air outlet channel, and the other end of the main air outlet channel 22 is only connected to the front air outlet channel 23, directing the airflow to the front of the floor cleaning device, so that the fan assembly 30 blows air towards the front of the main body 20, avoiding the wind blowing directly to the user, while reducing the noise of the wind heard by the user and improving the user's experience.

The front and rear sides may be determined with reference to the direction of movement of the floor cleaning device during use. A user may stand at the rear of the floor cleaning device to operate it, and the brush assembly 10 may move close to the ground to clean the floor.

Furthermore, the floor cleaning device may comprise a bent pipe 50 or a tube with similar or different shape. One end (e.g., a first end) of the bent pipe 50 may be connected to the main body 20 and the other end (e.g., a second end) of the bent pipe 50 may be connected to the brush assembly 10. Referring to FIG. 1, the brush assembly 10 may comprise a cleaning member 110 and a connecting member 120, and the suction port 11 may be opened on the connecting member 120. The cleaning member 110 may be installed on the connecting member 120, and the connecting member 120 may comprise a roller. The lower end of the bent pipe 50 may be connected to the connecting member 120, and the upper end of the bent pipe 50 may be connected to the main body 20. The roller may roll forward, driving the connecting member 120, the cleaning member 110, and the main body 20 to move forward. During the movement, the cleaning member 110 may move to clean the floor, and the garbage (e.g., dust, dirt) may be lifted up to the suction port 11, and the air carrying the garbage may enter the main body 20 through the suction port 11 and the bent pipe 50 in turn. In an example, the bent pipe 50 may not be provided, and the main body 20 may be directly connected to the brush assembly 10.

The cleaning member 110 may comprise a brush (e.g., a columnar rolling brush), which may be kept wet during use and can be rolled and dragged on the floor during movement. The brush may roll on the front side, making the area it passes through wet and slippery. The switching mechanism 40 can be switched to the second state to direct the air to blow the floor through the rear air outlet channel 24. When there is more dust or light garbage such as hair on the floor, the switching mechanism 40 can be switched to the first state to direct the air to blow the front side of the main body 20 through the front air outlet channel 23, avoiding the garbage in the uncleaned areas on both sides of the main body 20 being blown away by the rear outlet and causing secondary pollution in the cleaning area. The cleaning member 110 can also be other structures, such as a brush with bristles that lifts the garbage and sweeps it towards the suction port 11 by rotating or swinging. During the cleaning process of the brush, the floor may not become wet. The switching mechanism 40 can be switched to the first state to direct the air to blow the front side of the main body 20 through the front air outlet channel 23, reducing noise and avoiding the wind blowing towards the user.

The floor cleaning device may also comprise a recovery bin 210 (e.g., a recovery box) set on the main body 20, with a recovery channel 21 inside. The suction port 11 and the air inlet 31 may be connected through the recovery channel 21, and the recovery bin 210 and the main body 20 may be separated to form the main air outlet channel 22 and the front air outlet channel 23. The airflow with garbage may enter through the suction port 11 and the garbage may be sucked into the recovery bin 210 via the recovery channel 21. The air may continue to flow upwards under the action of the fan assembly 30, enter the fan assembly 30 through the air inlet 31, may be blown out through the air outlet 32 to the main air outlet channel 22, and finally blown out of the main body 20 through the front air outlet channel 23 or the rear air outlet channel 24.

Figure 5:
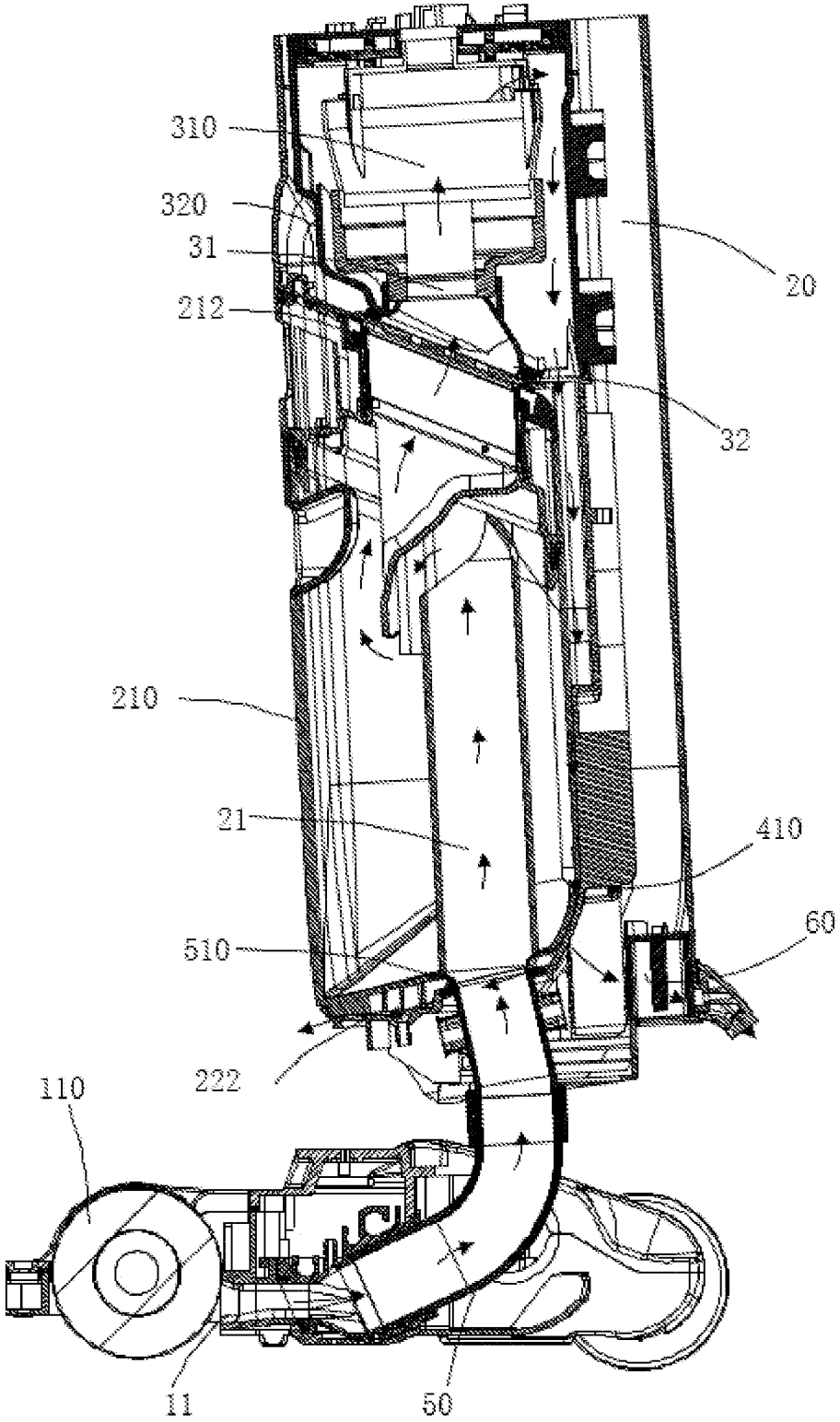
FIG. 5 is a semi-sectional view of the ground cleaning device.
Figure 6:
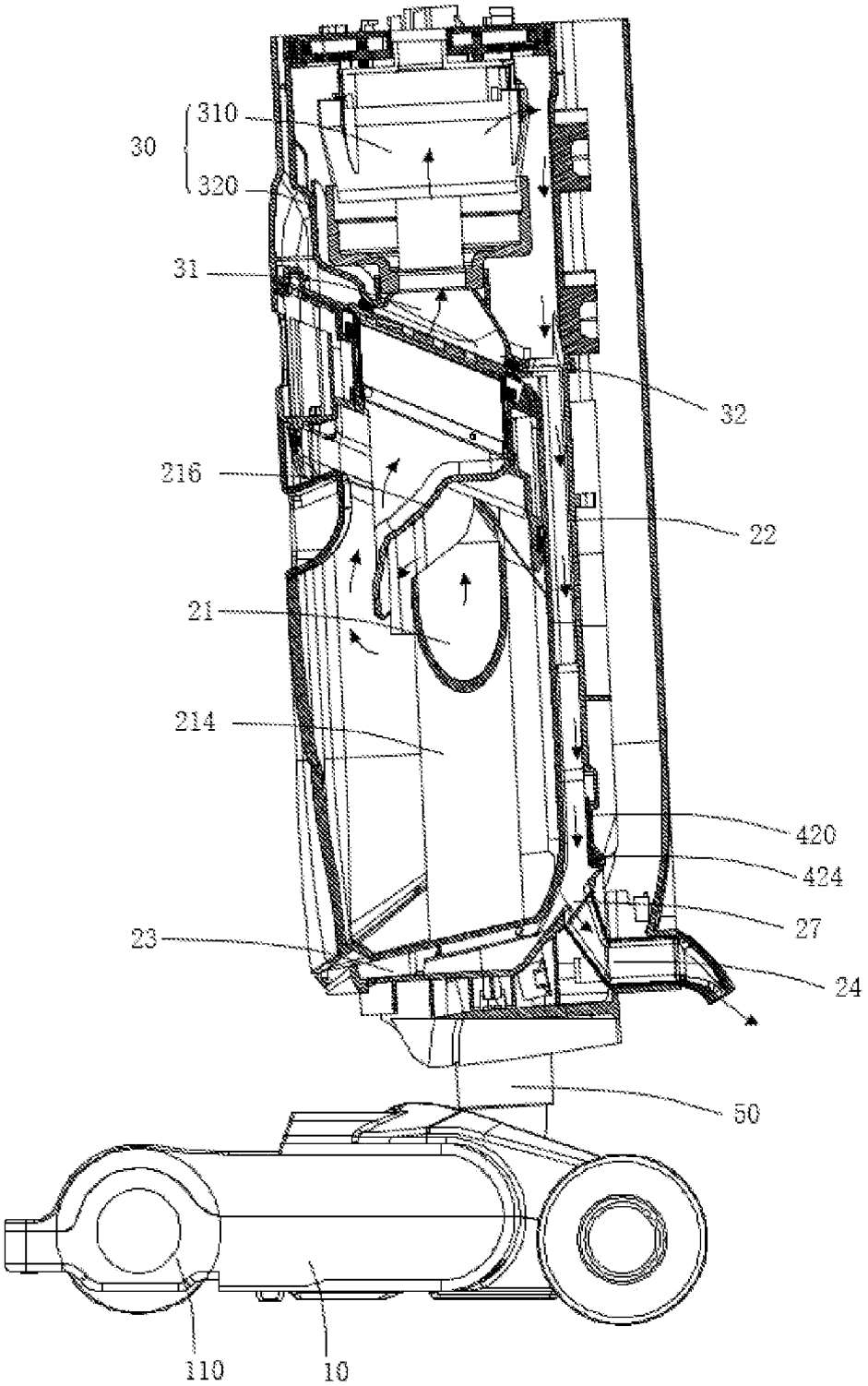
FIG. 6 is a sectional view of the ground cleaning device with rear air outlet.
Figure 7:
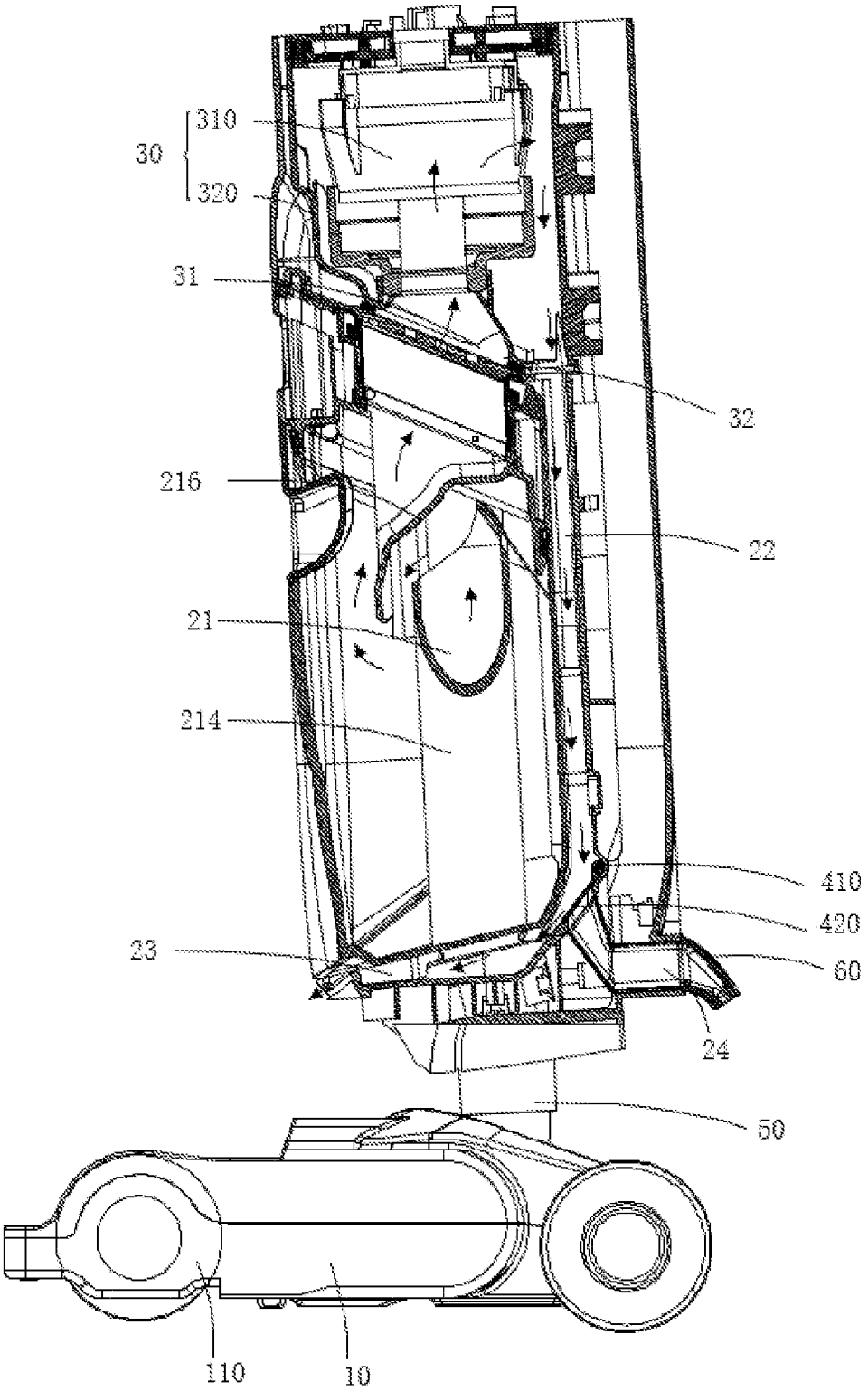
FIG. 7 is a sectional view of the ground cleaning device with front air outlet.

As shown in FIGS. 5-7, in an example, the recovery bin 210 may be equipped with an air duct 214 and a deflector plate 216. The air duct 214 may be vertically arranged, and the deflector plate 216 may be inclined above the air duct 214 and extend to the side and below the outlet of the air duct 214. The deflector plate 216 may be spaced between the inner wall of the air duct 214 and the recovery bin 210. The airflow passing through the bent pipe 50 may enter the air duct 214 and flow out of the outlet of the air duct 214, and then flow down along the gap between the air duct 214 and the deflector plate 216 into the recovery bin 210. The airflow may then flow up along the gap between the inner wall of the recovery bin 210 and the deflector plate 216, and enter the fan assembly 30 through the outlet above the recovery bin 210 and the air inlet 31 of the fan assembly 30. During the process of the airflow flowing around the deflector plate 216, the garbage may be sucked into the recovery bin 210.

As shown in FIG. 5, the upper end of the bent pipe 50 may be provided with a first sealing ring 510. The upper end of the bent pipe 50 may be sealed and connected to the corresponding air duct 214 of the recovery bin 210 at the lower end through the first sealing ring 510. The upper end of the recovery bin 210 may be provided with a second sealing ring 212. The upper end of the recovery bin 210 may be sealed and connected to the air inlet 31 of the corresponding fan assembly 30 of the main body 20 through the second sealing ring 212, thereby forming a sealed recovery channel 21. Negative pressure may be generated at the suction port 11, allowing the garbage to be smoothly sucked into the recovery bin 210. The first sealing ring 510 and the second sealing ring 212 can be made of airtight materials such as soft rubber and foam.

As shown in FIGS. 1, 5, 6, and 7, in an example, the recovery bin 210 may be detachably connected to the main body 20. The rear side of the recovery bin 210 and the front side of the main body 20 may be separated to form the main air outlet channel 22, and the lower side of the recovery bin 210 and the upper side of the main body 20 may be separated to form the front air outlet channel 23. The rear air outlet channel 24 may be located inside the main body 20. By connecting the recovery bin 210 to the main body 20, the main air outlet channel 22 and the front air outlet channel 23 are formed, avoiding the need for additional air ducts and reducing manufacturing costs. By detaching the recovery bin 210, it is easy to clean the main air outlet channel 22 and the front air outlet channel 23.

The brush assembly 10 may clean the floor and collect the dirt into the recovery bin 210. The floor cleaning device may also comprise a water tank, which may be set on the main body 20 to provide clean water to the cleaning member 110 and/or floor.

As shown in FIGS. 1, 5, 6, and 7, in an example, the fan assembly 30 may comprise a fan body 310 and an outlet casing 320. The fan body 310 may be located inside the outlet casing 320, and the air inlet 31 and the air outlet 32 may be arranged along the direction of forward movement of the floor cleaning device, with the air inlet 31 located at the front bottom of the outlet casing 320 and the air outlet 32 located at the rear bottom of the outlet casing 320. The airflow may enter the fan body 310 through the air inlet 31 at the front bottom of the outlet casing 320, and may be blown out of the outlet 32 at the rear bottom of the outlet casing 320, directly flowing into the main air outlet channel 22 without obstruction, with low wind resistance, and effectively reducing the energy consumption of the fan body 310.

The air inlet 31 and the air outlet 32 may be located on the same side of the fan assembly 30, and both are located on the side of the fan assembly 30 close to the brush assembly 10. This setting facilitates the connection of the air inlet 31 and the air outlet 32 with the relevant channels, effectively reduces the layout of pipelines, and reduces manufacturing costs.

In an example, the fan assembly 30 may be detachably connected to the main body 20. The fan assembly 30 can be detached from the main body 20 and connected to other accessories as the power part of a handheld vacuum cleaner, improving flexibility of use.

Referring to FIGS. 1, 6, and 7, in an example, the switching mechanism 40 may comprise a switching cover 420 that is movably connected to the main body 20 and used to move relative to the main body 20 between a first state and a second state.

In an example, the switching mechanism 40 may further comprise a pivot shaft 410, and the switching cover 420 is rotatably connected to the main body 20 via the pivot shaft 410.

In an example, one end of the switching cover 420 may be provided with a shaft hole 422, and the pivot shaft 410 may be inserted through the shaft hole 422. The two sides of the main air outlet channel 22 may be respectively provided with mounting holes 25, and the two ends of the pivot shaft 410 may be respectively inserted into the corresponding mounting holes 25. By rotating the switching cover 420 relative to the main body 20, the main air outlet channel 22 can be switched to communicate with the rear air outlet channel 24 or the front air outlet channel 23 to meet different usage requirements. The switching cover 420 can be manually adjusted by removing the recovery bin 210 and manipulating the switching cover 420.

Figure 3:
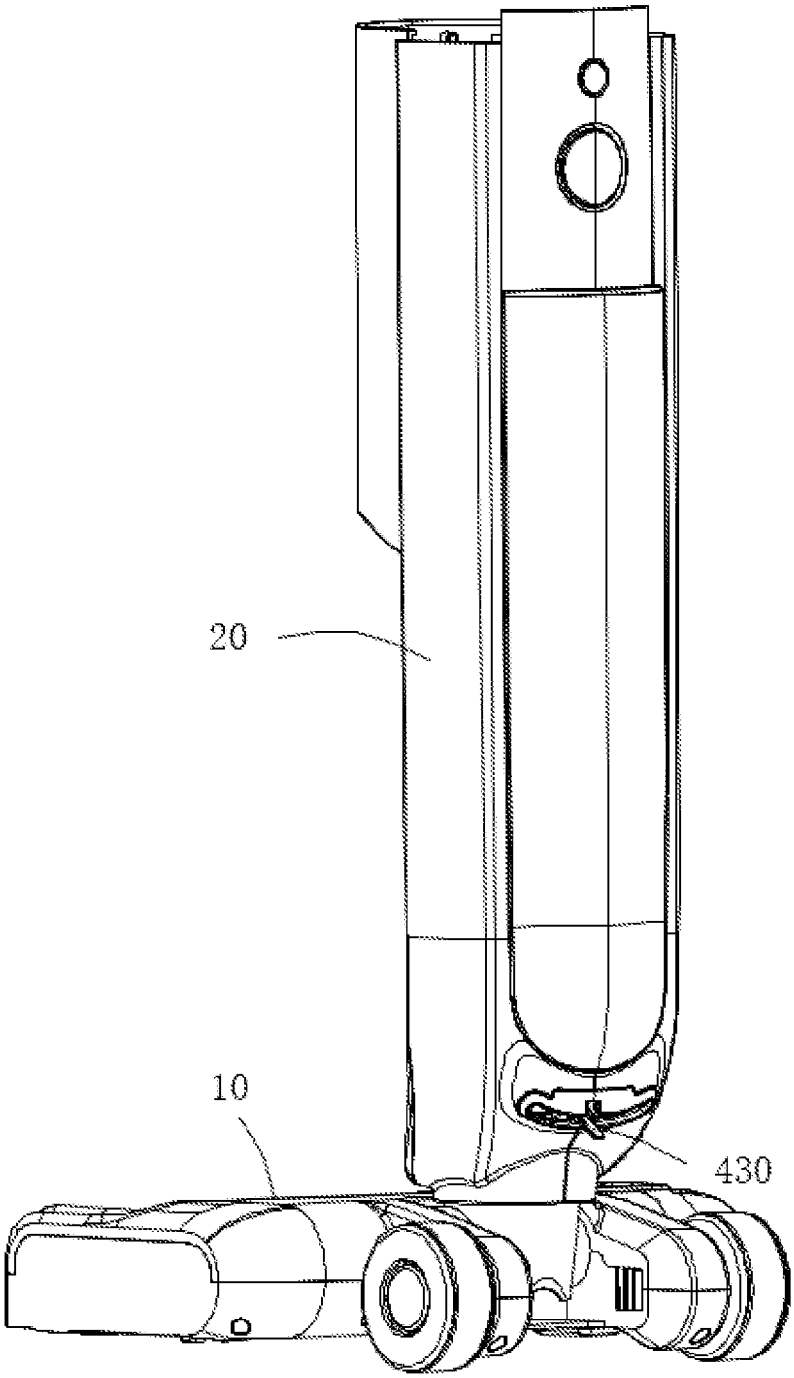
FIG. 3 is an assembly view of the ground cleaning device.
Figure 4:
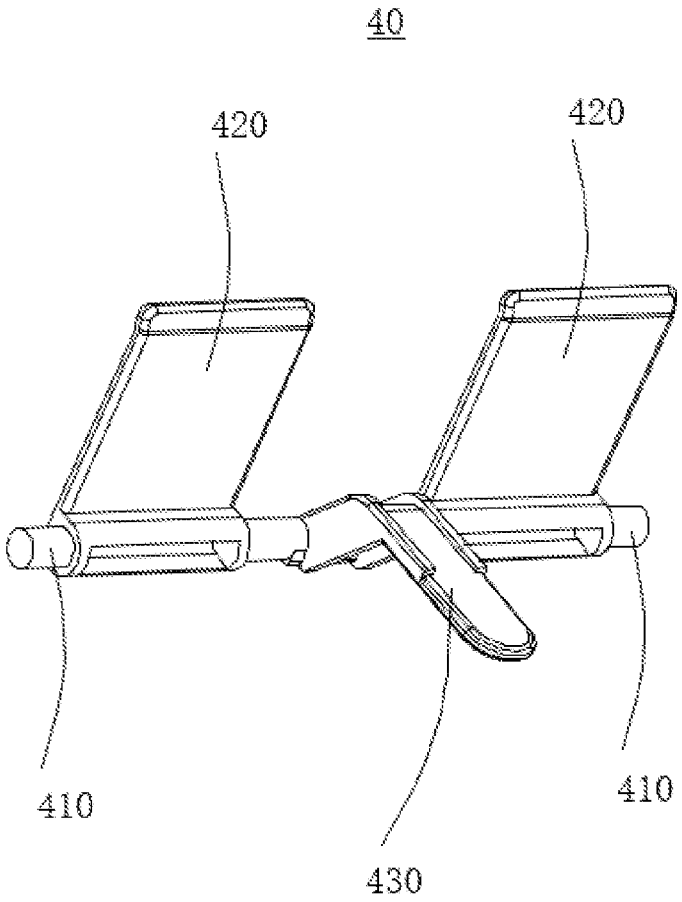
FIG. 4 is a structural schematic view of a switching mechanism of the ground cleaning device.

Referring to FIGS. 3 and 4, in an example, the switching mechanism 40 may further comprise a lever 430. One end of the lever 430 may be fixed to the pivot shaft 410 and the other end of the lever 430 may extend out of the main body 20. The switching cover 420 may be fixedly connected to the pivot shaft 410, which can be rotatably mounted in the mounting hole 25 without removing the recovery bin 210. By directly manipulating the lever 430, the pivot shaft 410 can be rotated to drive the switching cover 420 to switch between the first and second states, making it easy and convenient to operate.

In an example, the lever 430 can be fixed to the end of the switching cover 420 with the pivot shaft 410, and the other end of the lever 430 may extend out of the main body 20. The pivot shaft 410 may be fixedly connected to the switching cover 420 and can be rotatably mounted in the mounting hole 25. By manipulating (e.g., placing) the lever 430, the switching cover 420 can be rotated relative to the pivot shaft 410 to adjust its state.

In an example, the switching mechanism 40 may further comprise a driving member that is connected to the switching cover 420 for driving the switching cover 420 to move relative to the main body 20. The driving member can be an electric motor or the like that drives the switching cover 420 to rotate automatically to adjust its state.

A first sensing switch may be provided on the main body 20, and when the switching mechanism 40 is in the first state, the switching cover 420 can contact the first sensing switch. For example, when the switching cover 420 completely closes the rear air outlet channel 24, the switching cover 420 can trigger the first sensing switch, and the floor cleaning device may blow air to the front side of the main body 20 through the front air outlet channel 23.

Additionally, a second sensing switch may be provided on the main body 20, and when the switching mechanism 40 is in the second state, the switching cover 420 can contact the second sensing switch. For example, when the switching cover 420 completely opens the rear air outlet channel 24, the switching cover 420 can trigger the second sensing switch, and the floor cleaning device may blow air to the cleaning surface through the rear air outlet channel 24. The cleaning surface refers to the area that has been cleaned by the floor cleaning device, e.g., the area behind the floor cleaning device. The terms "front" and "rear" are based on the direction of movement of the floor cleaning device.

The floor cleaning device may further comprise a controller that is connected to the driving member and is used to control the driving member to move the switching cover 420 according to the received instructions (e.g., signals) for front or rear air blowing. When the controller receives a sensing signal (e.g., an induction signal) from the first or second sensing switch, the controller may control the driving member to stop running. By coordinating with the first and/or second sensing switches, the controller can intelligently control the opening and closing of the driving member, making the operation more convenient and faster.

The floor cleaning device may further comprise a controller that is connected to the driving member and is configured to control the driving member to move the switching cover 420 according to the received instructions for front or rear air blowing. When the controller receives a sensing signal from the first or second sensing switch, the controller may control the driving member to continue running for T1 seconds before stopping. Due to assembly errors and tolerances of various parts of the floor cleaning device, when the switching cover 420 has contacted the first or second sensing switch, it may not be completely open or closed. In this case, the controller can control the driving member to continue running for T1 seconds (or a predetermined portion of T1 seconds) after receiving the sensing signal, to solve the problem of incomplete opening or closing caused by possible errors. T1 can be flexibly set according to the actual product. In an example, T1 may be between 0 and 10 seconds.

Additionally or alternatively, when an operating current of the driving member (e.g., an operating current at the input or output of the driving member) is greater than or equal to a preset current and the controller receives a sensing signal from the first or second sensing switch, the controller may control the driving member to stop running. Compared with the above two examples, this example introduces detection of the operating current of the driving member. The preset current may be a value pre-stored in the controller and can be obtained by detecting the operating current when the driving member drives the switching cover 420 to completely open or close. When the switching cover 420 contacts or leaves the first or second sensing switch, there may be a certain resistance, causing the operating current of the driving member to increase momentarily.

By dual-judging the operating current of the driving member and the sensing signal, the switching cover 420 can be rotated to completely open or close, ensuring that the floor cleaning device can completely blow air to the rear or front, and avoiding air leakage. For example, when receiving the instruction for front air blowing, if the operating current of the driving member is greater than or equal to the preset current and the first sensing switch sends a sensing signal, the controller may determine that the switching cover 420 has rotated to the completely closed position; when receiving the instruction for rear air blowing, if the operating current of the driving member is greater than or equal to the preset current and the second sensing switch sends a sensing signal, the controller may determine that the switching cover 420 has rotated to the completely open position.

Furthermore, when the operating current of the driving member is greater than or equal to the preset current and the controller has not received any sensing signal from the first or second induction switch, the controller may control the driving component to continue running for T2 seconds. If the controller still has not received any sensing signal from the first or second sensing switch after T2 seconds, the controller may control the driving member to stop running. At this time, the controller can output fault information through the operation interface display, voice prompts, mobile app push notifications, etc., to notify the staff to troubleshoot in a timely manner. T2 can be flexibly set according to the actual product. In an example, T2 may be between 0 and 10 seconds.

Due to possible problems such as jamming during the operation of the switching cover 420, timely detection of whether the switching cover 420 has rotated to the fully open or fully closed position can be achieved through the dual judgment of the operating current of the driving component and the induction signal. This can avoid air leakage. Specifically, when the instruction for front air outlet is received, if the operating current of the driving member is greater than or equal to the preset current and no sensing signal is received from the first sensing switch, it can be determined that the switching cover 420 has not rotated to the fully closed position if the driving member continues to run for T2 seconds without receiving any sensing signal from the first sensing switch. When the instruction for rear air outlet is received, if the operating current of the driving member is greater than or equal to the preset current and no sensing signal is received from the second sensing switch, it can be determined that the switching cover 420 has not rotated to the fully open position if the driving member continues to run for T2 seconds without receiving any sensing signal from the second sensing switch.

Additionally, the controller may be used to control the driving member to move the switching cover 420 for T3 seconds according to the received instruction for front or rear air outlet. When the operating current of the driving member is greater than or equal to the preset current, the controller may control the driving member to stop running. T3 can be set as half of the time required for the driving member to drive the switching cover 420 to complete one cycle of fully open state, fully closed state, and fully open state. The preset current may be the same as described in the above examples. After the driving member drives the switching cover 420 to complete one cycle of fully open state to fully closed state, the operating current of the driving member may be further detected. Through the dual judgment, it is ensured that the switching cover 420 has rotated to the fully open or fully closed position, thereby ensuring that the floor cleaning device can fully blow out the rear or front air outlet without air leakage.

The starting point of T3 can be calculated from the instruction of front air outlet or rear air outlet received by the controller, without setting the first sensing switch and the second sensing switch. Alternatively, when the front air outlet instruction is received by the controller, the second induction switch may send an sensing signal as the switching cover 420 needs to leave the second sensing switch from the fully open position, and the controller may start calculating T3 upon receiving the sensing signal sent by the second sensing switch. Alternatively, when the rear air outlet instruction is received by the controller, the first sensing switch may send a sensing signal as the switching cover 420 needs to leave the fully closed position of the first sensing switch, and the controller may start calculating T3 upon receiving the sensing signal sent by the first sensing switch.

In addition, when the operating current of the driving member is less than the preset current, the controller may control the driving member to continue running for T4 seconds. If the working current of the driving member is still less than the preset current after T4 seconds, the controller may control the driving member to stop running. At this time, the controller can output fault information through the operation interface display, voice prompts, mobile app push notifications, etc., to notify the staff to troubleshoot in a timely manner. T4 can be flexibly set according to the actual product. In an example, T4 may be between 0 and 10 seconds. Due to possible problems such as jamming during the operation of the switching cover 420, the operating current of the driving member may be checked again after the driving member drives the switching cover 420 to continue running for T4 seconds. If the operating current of the driving member is still less than the preset current, it can be detected in a timely manner whether the switching cover 420 has rotated to the fully open or fully closed position, thereby avoiding air leakage.

Referring to FIGS. 1, 5, 6, and 7, in an example, the main air outlet channel 22 may extend along the height direction of the main body. The front air outlet channel 23 may extend along the direction of the floor cleaning device's forward movement. The entrance of the rear air outlet channel 24 may face the extension direction of the main air outlet channel 22. In the first state, the switching cover 420 may be set on the entrance of the rear air outlet channel 24, and the switching cover 420 may be tilted along the extension direction of the front air outlet channel 23. When the switching cover 420 is not set on the entrance of the rear air outlet channel 24, since the main air outlet channel 22 extends along the height direction of the main body and the entrance of the rear air outlet channel 24 faces the extension direction of the main air outlet channel 22, the air flowing out along the main air outlet channel 22 may directly blow towards the rear of the main body from below. When the switching cover 420 is set on the entrance of the rear air outlet channel 24 and tilted along the extension direction of the front air outlet channel 23, the air flowing out along the main air outlet channel 22 cannot enter the rear air outlet channel 24, but is blown towards the front air outlet channel 23 under the guidance of the switching cover 420, and then blown out from the front of the main body. There is no obstruction in the air outlet direction, and the air resistance is small, which further reduces the energy consumption of the fan body 20.

Referring to FIG. 1, in an example, the main air outlet channel 22 may be provided with at least two outlets (e.g., the front air outlet channel 23 and the rear air outlet channel 24). This setting facilitates the flexible setting of various components of the floor cleaning device, allowing the airflow to be discharged from the front or rear side of the main body 20. The number of outlets required for the main exhaust duct 22 can be set according to the usage requirements, such as one, two, or three, etc. The outlet of the main air outlet channel 22 may correspond to the switching cover 420, so that the outlet of the main air outlet channel 22 can be connected or disconnected from the rear air outlet channel 24.

In an example, the front side of the main body 20 may be provided with a Y-shaped groove 29, and the rear side of the recovery bin 210 may be connected to the Y-shaped main air outlet channel 22 formed by the Y-shaped groove 29. The main air outlet channel 22 may comprise a main branch along the vertical direction and two branches 291 branching out from the end of the main branch to both sides. The air blown out from the air outlet 32 may first enter the main branch and then may be divided into two branches 291. The front air outlet channel 23 and the rear air outlet channel 24 may be respectively connected to the two branches 291 of the main air outlet channel 22. The shaft 410 and the switching cover 420 may be respectively set at the two branches 291 of the main air outlet channel 22. By setting the shaft 410 and the switching cover 420 at each branch 291, the front air outlet channel 23 and the rear air outlet channel 24 on the corresponding side can be switched to meet different scene requirements.

Referring to FIG. 4, in an example, the two shafts 410 can be fixedly connected as one, and the lever 430 may be set in the middle to adjust the two switching covers 420 at the same time. Alternatively, a driving member can be set between the two branches 291 to simultaneously drive the two shafts 410 to rotate and adjust the two switching covers 420.

Referring to FIG. 1, in an example, the bottom of the main body 20 may be provided with a connection hole 26. One end of the bent pipe 50 may be sealedly connected to the connection hole 26, the other end of the bent pipe 50 may be sealably connected to the brush 10 and communicate with the suction port 11, and the recovery duct 21 in the recovery bin 210 may be sealably connected to the connection hole 26. The two front air outlet channels 23 may be located on both sides of the connection hole 26. For example, the two air outlet channels 23 may be connected to the two branches 291 of the main air outlet channel 22 by being respectively abutted against the two sides of the bottom of the recovery bin 210. The recovery duct 21 may be set between the two front air outlet channels 23, and the front air outlet channel 23 may be extended from the main body 20 to the front of the recovery bin 210, avoiding the recovery duct 21.

The main body 20 may include a main shell 222 (e.g., housing) and a rear shell 224 that are connected to each other, and the recovery bin 210 may be connected to the main shell 222. The main air outlet channel 22 may be formed at the rear of the recovery bin 210, and the front air outlet channel 23 may be formed on both sides of the bottom of the recovery bin 210. The front air outlet channel 23 may extend downwardly from the rear of the recovery bin 210 to its bottom and is smoothly connected to the main air outlet channel 22.

Furthermore, referring to FIGS. 1, 6, and 7, the floor cleaning device may further comprise a rear exhaust assembly 60, which may comprise a hollow structure forming the rear air outlet channel 24. The fan assembly 30 may be located at the upper part of the cavity surrounded by the main shell 222 and the rear shell 224. The rear exhaust assembly 60 may be located at the lower part of the cavity surrounded by the main shell 222 and the rear shell 224. The end of the main air outlet channel 22 of the main shell 222 is provided with an opening 27, and the inlet of the rear exhaust assembly 60 may be connected to the opening 27. The outlet of the rear exhaust assembly 60 may extend out of the rear shell 224 and face downwardly to the rear side of the rear shell 224. When the opening 27 is unobstructed and faces the extension direction of the main air outlet channel 22, the air can directly enter the rear air outlet channel 24 through the opening 27.

Furthermore, the rear exhaust assembly 60 may comprise a first pipe shell 610 set inside the rear shell 224 and a second pipe shell 620 extending out of the rear shell 224. One end of the first pipe shell 610 may be connected to the opening 27, the other end of the first pipe shell 610 may be connected to one end of the second pipe shell 620, and the other end of the second pipe shell 620 may face the ground. The first pipe shell 610 and the second pipe shell 620 may comprise hollow structures, and the rear air outlet channel 24 may be formed inside. The air flowing out of the opening 27 may blow toward the ground at the rear under the guidance of the first pipe shell 610 and the second pipe shell 620. Furthermore, the two branches 291 of the main air outlet channel 22 may be both provided with the opening 27 at the end, and the two sides of the first pipe shell 610 and the second pipe shell 620 may be correspondingly provided with the rear air outlet channel 24, which are respectively connected to the two openings 27. When the switching mechanism 40 is in the second state, the air flowing out of the two branches 291 may be blown out through the rear air outlet channels 24 on both sides. One end of the first pipe shell 610 may be sealably connected to the main shell 222, and the other end may be sealably connected to the second pipe shell 620. In the second state, all the air may be blown toward the ground from the outlet of the second pipe shell 620.

Referring to FIGS. 1, 6, and 7, the main shell 222 may be provided with an embedded groove 28 on the upper side corresponding to the opening 27, and the two side walls of the embedded groove 28 may be respectively provided with mounting holes 25. One end of the switching cover 420 may be provided with a card holder 424 that matches the embedded groove 28. The card holder 424 may be provided with a shaft hole 422. When the switching cover 420 is opened and flipped up in the second state, the card holder 424 may be locked in the embedded groove 28 by the card holder 424 and the embedded groove 28. By matching the card holder 424 with the embedded groove 28, the switching cover 420 can be kept in the second state without flipping down when there is no user operation, avoiding the switching cover 420 from covering the opening 27 and affecting the rearward airflow.

The floor cleaning device described herein may be a cleaning machine such as a floor washer and/or a floor sweeper.

The various technical features of the above-described examples can be combined. In order to keep the description concise, not all possible combinations of the technical features in the above examples are described. However, as long as the combination of these technical features does not contradict each other, it should be considered as within the scope of the present specification.

The above-described examples only express several examples of the present disclosure, which are described in a specific and detailed manner. However, this should not be understood as limiting the scope of present disclosure. It should be pointed out that for those skilled in the art, various modifications and improvements can be made without departing from the concept of the present disclosure, and these are all within the scope of protection of the present disclosure.

What is claimed is:

1. A ground cleaning device, comprising:

a ground brush;

a main body that comprises a main air outlet channel, a front air outlet channel, and a rear air outlet channel;

a fan located on the main body and comprising an air inlet and an air outlet; and a switching device, wherein:

the ground brush is connected to the main body and comprises a suction port, the suction port is connected to the air inlet, a first end of the main air outlet channel is connected to the air outlet, a second end of the main air outlet channel is connected to the switching device, the switching device has a first state and a second state, and when the switching device is in the first state, the rear air outlet channel is isolated from the main air outlet channel and the front air outlet channel is connected to the main air outlet channel, and when the switching device is in the second state, the rear air outlet channel is connected to the main air outlet channel, and the rear air outlet channel is configured to guide a first airflow to a back side of the ground cleaning device, and the front air outlet channel is configured to guide a second airflow to a front side of the ground cleaning device.

2. The ground cleaning device according to claim 1, further comprising a recovery box provided on the main body, wherein:

the recovery box comprises a recovery channel, the suction port is connected to the air inlet via the recovery channel, and the main air outlet channel and the front air outlet channel are formed by a gap between the recovery box and the main body.

3. The ground cleaning device according to claim 2, wherein:

the main air outlet channel extends along a vertical direction of the main body, an outlet of the main air outlet channel is above an inlet of the rear air outlet channel, and the front air outlet channel extends along a forward moving direction of the ground cleaning device.

4. The ground cleaning device according to claim 2, further comprising a bent pipe, wherein the bent pipe is connected between the suction port and the recovery channel.

5. The ground cleaning device according to claim 2, wherein the recovery box is detachably connected to the main body.

6. The ground cleaning device according to claim 1, wherein:

the fan is detachably connected to the main body, and the air inlet and the air outlet are both located on a side of the fan close to the ground brush.

7. The ground cleaning device according to claim 6, wherein:

the fan comprises a fan body and an air outlet shell, the fan body is located inside the air outlet shell, the air inlet and the air outlet are both located at the bottom of the air outlet shell, the air inlet and the air outlet are arranged along a forward moving direction of the ground cleaning device, and the air inlet is located in front of the air outlet.

8. The ground cleaning device according to claim 1, wherein:

the switching device comprises a switching cover movably connected to the main body, and the switching cover is configured to move relative to the main body.

9. The ground cleaning device according to claim 8, wherein:

the switching device further comprises a rotating shaft and a lever, the switching cover is rotatably connected to the main body through the rotating shaft, a first end of the lever is fixedly connected to the rotating shaft, and a second end of the lever extends out of the main body.

10. The ground cleaning device according to claim 8, wherein the switching device further comprises a driving member connected to the switching cover and configured to drive the switching cover to move relative to the main body.

11. The ground cleaning device according to claim 10, wherein:

the main body is provided with a first sensing switch, and based on the switching device being in the first state, the switching cover is connected to the first sensing switch, and the main body is provided with a second sensing switch, and based on the switching device being in the second state, the switching cover is connected to the second sensing switch.

12. The ground cleaning device according to claim 11, further comprising a controller, wherein:

the controller is configured to control a driving member to drive the switching cover, based on the controller receiving a signal from the first sensing switch or the second sensing switch, the controller is configured to control the driving member to stop running.

13. The ground cleaning device according to claim 12, wherein:

the controller is configured to control the driving member to stop running based on a current associated with the driving member being greater than or equal to a preset current and based on that the controller receiving a signal from the first sensing switch or the second sensing switch, and the controller is configured to control the driving member to continue running for a period of time based on a current associated with the driving member being greater than or equal to the preset current and based on that the controller not receiving a signal from the first sensing switch or the second sensing switch.

14. The ground cleaning device according to claim 1, wherein both the front air outlet channel and the rear air outlet channel are disposed below the main air outlet channel.

15. A cleaning device, comprising:

a main body that comprises a main air outlet channel, a front air outlet channel, and a rear air outlet channel;

a fan located on the main body and comprising an air inlet and an air outlet;

a suction port connected to the air inlet; and a switching device, wherein:

a first end of the main air outlet channel is connected to the air outlet, a second end of the main air outlet channel is connected to the switching device, the switching device is configured to connect the main air outlet channel to one of the rear air outlet channel or the front air outlet channel, the switching device has a first state and a second state, and when the switching device is in the first state, the rear air outlet channel is isolated from the main air outlet channel and the front air outlet channel is connected to the main air outlet channel, and when the switching device is in the second state, the rear air outlet channel is connected to the main air outlet channel, and the rear air outlet channel is configured to guide a first airflow to a back side of the cleaning device, and the front air outlet channel is configured to guide a second airflow to a front side of the cleaning device.

16. The cleaning device of claim 15, wherein the switching device is configured to disconnect the main air outlet channel from one of the rear air outlet channel or the front air outlet channel.

17. The cleaning device of claim 15, further comprising a controller, wherein the controller is configured to control movement of the switching device based on receiving a signal associated with connection of the main air outlet channel to the one of the rear air outlet channel or the front air outlet channel, and wherein the switching device is configured to connect, based on a user instruction, the main air outlet channel to one of the rear air outlet channel or the front air outlet channel.

18. The cleaning device of claim 15, wherein:

the main body comprises a first sensing switch and a second sensing switch, and at least one of the first sensing switch or the second sensing switch is configured to send a signal to the switching device.

19. The cleaning device according to claim 15, wherein both the front air outlet channel and the rear air outlet channel are disposed below the main air outlet channel.

20. A cleaning device for cleaning a floor, comprising:

a brush assembly;

a main body coupled to the brush assembly, the main body comprising:

a fan with an air outlet, a front air outlet channel, and a rear air outlet channel spaced from the front air outlet channel and directed towards the floor behind the brush assembly, and a switching device, wherein the switching device is configured to be movable between at least first and second states such that when the switching device is in the first state, the cleaning device is configured to enable air from the air outlet of the fan to be expelled through the front air outlet channel and prevent air to be expelled through the rear air outlet channel, and such that when the switching device is in the second state, the cleaning device is configured to enable air from the air outlet of the fan to be expelled through the rear air outlet channel towards the floor behind the brush assembly.

* * * * *